US005826641A

United States Patent [19]

Bierwirth et al.

[11] Patent Number: 5,826,641

[45] Date of Patent: Oct. 27, 1998

[54] AIR CONDITIONER WITH HEAT WHEEL

[75] Inventors: Henry C. Bierwirth; Stephen J. Pargeter, both of Tulsa, Okla.

[73] Assignee: Aaon, Inc., Tulsa, Okla.

[21] Appl. No.: 943,461

[22] Filed: Oct. 3, 1997

Related U.S. Application Data

[63] Continuation-in-part of Ser. No. 330,330, Oct. 27, 1994, abandoned.

[51] Int. Cl.[6] ..... F25D 17/06; F25B 29/00

[52] U.S. Cl. ..... 165/48.1; 165/54; 165/66; 165/8; 62/271; 62/94

[58] Field of Search ..... 62/271, 94; 165/8, 165/48.1, 54, 66

[56] References Cited

U.S. PATENT DOCUMENTS

| | | | |
|---|---|---|---|
| 4,109,708 | 8/1978 | Imral | 165/48.1 |
| 4,142,575 | 3/1979 | Glancy | 165/66 |
| 5,325,676 | 7/1994 | Meckler | 62/94 |
| 5,348,077 | 9/1994 | Hillman | 165/48.1 |
| 5,423,187 | 6/1995 | Fournier | 62/271 |
| 5,502,975 | 4/1996 | Brickley et al. | 62/271 |

FOREIGN PATENT DOCUMENTS

| | | | |
|---|---|---|---|
| 2729862 | 12/1978 | Germany | 165/54 |
| 3602120 | 8/1987 | Germany | 237/46 |
| 3-246115 | 11/1991 | Japan | 237/46 |
| 4-110552 | 4/1992 | Japan | 165/21 |
| 5-157391 | 6/1993 | Japan | 165/20 |

*Primary Examiner*—John K. Ford
*Attorney, Agent, or Firm*—Molly D. McKay

[57] ABSTRACT

A method and device for concurrently transferring sensible heat from the warmer of either an incoming outside airstream or an outgoing exhaust airstream to the other stream and transferring latent heat from the wetter of either the incoming outside airstream or the outgoing exhaust airstream to the other stream prior to the incoming airstream entering a standard heating and air conditioning unit. The method and apparatus both employ a rotating heat wheel impregnated with a dry desiccant such as silica gel in order to accomplish the simultaneous transfer of both sensible and latent heat between the two airstreams.

4 Claims, 4 Drawing Sheets

AIR CONDITIONER WITH HEAT WHEEL

This application is a continuation-in-part of application Ser. No. 08/330,330 filed on Oct. 27, 1994, now abandoned.

BACKGROUND OF THE INVENTION

1. Field of the Invention

The present invention relates to a method and device for conditioning air for use inside of buildings. More specifically, the present invention is a method and device for simultaneously altering both the sensible and latent heat of an airstream and thereby increasing the efficiency of the air conditioning system into which the airstream flows.

2. Description of the Related Art

Modern buildings are designed with air conditioning units for supplying heated or cooled air to the interior of the buildings. Such air conditioning units typically provide chilled air to the interiors of the buildings during the warm summer months, heated air to the buildings during the cool winter months, and provide for air circulation within the buildings during the entire year.

In some buildings, the interior air is recirculated through the air conditioning units without bringing fresh air into the buildings. This is done particularly during the summer and winter months in order to reduce the energy required to cool or heat, respectively, the fresh warm outside summer air or cool outside winter air. Although less energy is consumed to cool or heat the recirculated air than would be required to cool or heat fresh air supplied from outside the building, recirculating air within the buildings causes the air to become concentrated with pollutants and can cause the occupants of the buildings to become physically ill because of their constant exposure to these pollutants. Buildings in which increased occupant illness and absenteeism have been observed are known as "sick buildings". This condition is referred to as the "sick building syndrome".

In order to protect the health of its citizens, the U.S. Congress addressed the "sick building syndrome" by including certain provisions in the Clean Air Act which addressed the air quality of air located within public buildings. These provisions in the Clean Air Act resulted in generation of ASHRAE standard 62-1989. ASHRAE stands for the American Society of Heating, Refrigeration and Air-Conditioning Engineers, Inc. ASHRAE standard 62-1989 mandates a minimum acceptable quality of indoor air. One method for achieving this minimum indoor air quality is to bring air into the building from outside the building.

Bringing outside air into a building is quite expensive because it greatly increases the volume of outside air which must be cooled and heated by the air conditioning unit. In the summertime, in order to cool the warm outside air, it is desirable to remove both the sensible heat, i.e., the heat which can be felt and can be measured by using a dry bulb thermometer, and the latent heat, i.e., the heat which is associated with the moisture content of the air and can be indirectly measured by using a wet bulb thermometer. Conversely, in the wintertime, in order to heat the cold outside air, it is desirable to add both sensible heat and latent heat to the air.

Several methods and devices have been used in order to alter the sensible and latent heat of an airstream. Generally, these methods and devices include one set of steps and components designed to deal with the sensible heat and another set of steps and components to dealing with the latent heat. Also, generally the methods and devices designed to deal with the latent heat normally require input of energy in the form of heat or otherwise, in order to regenerate the component which removes the moisture from the airstream.

The present invention addresses this problem of handling an increased volume of outside air in a different way. A heat wheel is provided upstream of a standard air conditioning unit so that incoming outside air passes through an upper portion of the rotating heat wheel, and outgoing return air from the building passes countercurrent to the incoming air stream through a lower portion of the rotating heat wheel. In the summertime, the heat wheel removes both latent and sensible heat from the incoming warm, moist outside air and transfers the heat and moisture received from the outside air to the cooler, dryer outgoing return air which is then expelled from the unit as exhaust air. Likewise, in the wintertime, the heat wheel removes both latent and sensible heat from the outgoing warm, moist return air and transfers the heat and moisture received from the return air to the incoming cold, dry outside air. In so doing, the efficiency of the present air conditioning method and apparatus is increased roughly by a factor of one-third over the efficiency of the same type of unit when not provided with the heat wheel. This one-third increase in efficiency is based upon operation where three-fourths or more of the air circulated through the unit originates as outside air.

SUMMARY OF THE INVENTION

Briefly, the present invention is an air conditioning unit and method for conditioning air for use within a building. The unit is housed within a cabinet and has a first end and a second end. The first end is provided with an air intake duct through which outside air enters the unit and also an air exhaust duct through which exhaust air is blown out of the unit by means of an electrically driven exhaust fan provided within the air exhaust duct. A particulate filter is provided within the air intake duct between the first end and an electrically rotated heat wheel provided within the unit. A first half of the heat wheel is provided within the air intake duct and a second half of the heat wheel is provided within the air exhaust duct so that outside air entering the unit and exhaust air exiting the unit must pass respectively through the first and second halves of the heat wheel. The heat wheel transfer the sensible heat from the warmer to the cooler of the incoming outside air and the outgoing exhaust air and transfers the latent heat from the wetter to the dryer of the incoming outside air and the outgoing exhaust air. An electrically driven opposed blade mixing damper is provided inside the unit adjacent to the heat wheel and is the internal-most extension of the air intake and air exhaust ducts.

The unit is provided with a return air duct which enters the air exhaust duct between the second half of the heat wheel and the mixing damper. Return air entering the unit from the interior of the building via the return air duct will take different routes, depending on whether the blades of the mixing damper adjacent the air exhaust duct are fully closed, fully open or partially open. If the blades of the mixing damper adjacent the air exhaust duct are fully closed, 100% of the return air will exit the unit as exhaust air via the exhaust air duct. If the blades are fully open, 100% of the return air will pass through the mixing damper. If the blades are partially open, the return air will split into two flows, one exiting as exhaust air and one passing through the mixing damper as return air. Once the return air has passed through the mixing damper, it mixes with the treated outside air, if any, i.e., outside air which has passed through the heat wheel, to form a mixed air stream. The mixed air then passes through a second set of particulate filters, then through an evaporator provided adjacent the second set of particulate filters and which operates to chill the air in the summertime. After passing through the evaporator, the mixed air is known as supply air.

The supply air then passes through an optional reheat coil. During the humid spring and fall months when no change is required in the space air temperature but dehumidification is needed, the reheat coil receives excess heat from the cooling system's compressor which is located in a compartment on the second end of the unit and then transfers that excess heat to the supply air which has previously been chilled and dehumidified as it passed through the evaporator. The purpose of the reheat coil is to allow the unit to dehumidify the building's inside air without affecting the space temperature. To do this, the building's inside air is recirculated through the unit. As the air passes through the evaporator, it is chilled and part of its moisture condenses on the evaporator, runs down to the drip pan and flows out of the unit to the building's exterior. The chilled, dehumidified air is then rewarmed to its original temperature as it passes through the reheat coil.

Next, the supply air enters an electrically driven supply fan. The supply fan is provided with an auxiliary heater below and adjacent thereto which serves to heat the supply air during the winter months. The supply fan blows the either cooled or heated supply air throughout the interior of the building via building supply air ducts. Return air from the building reenters the unit via the return air duct.

DETAILED DESCRIPTION OF THE PREFERRED EMBODIMENT

Figure 1:
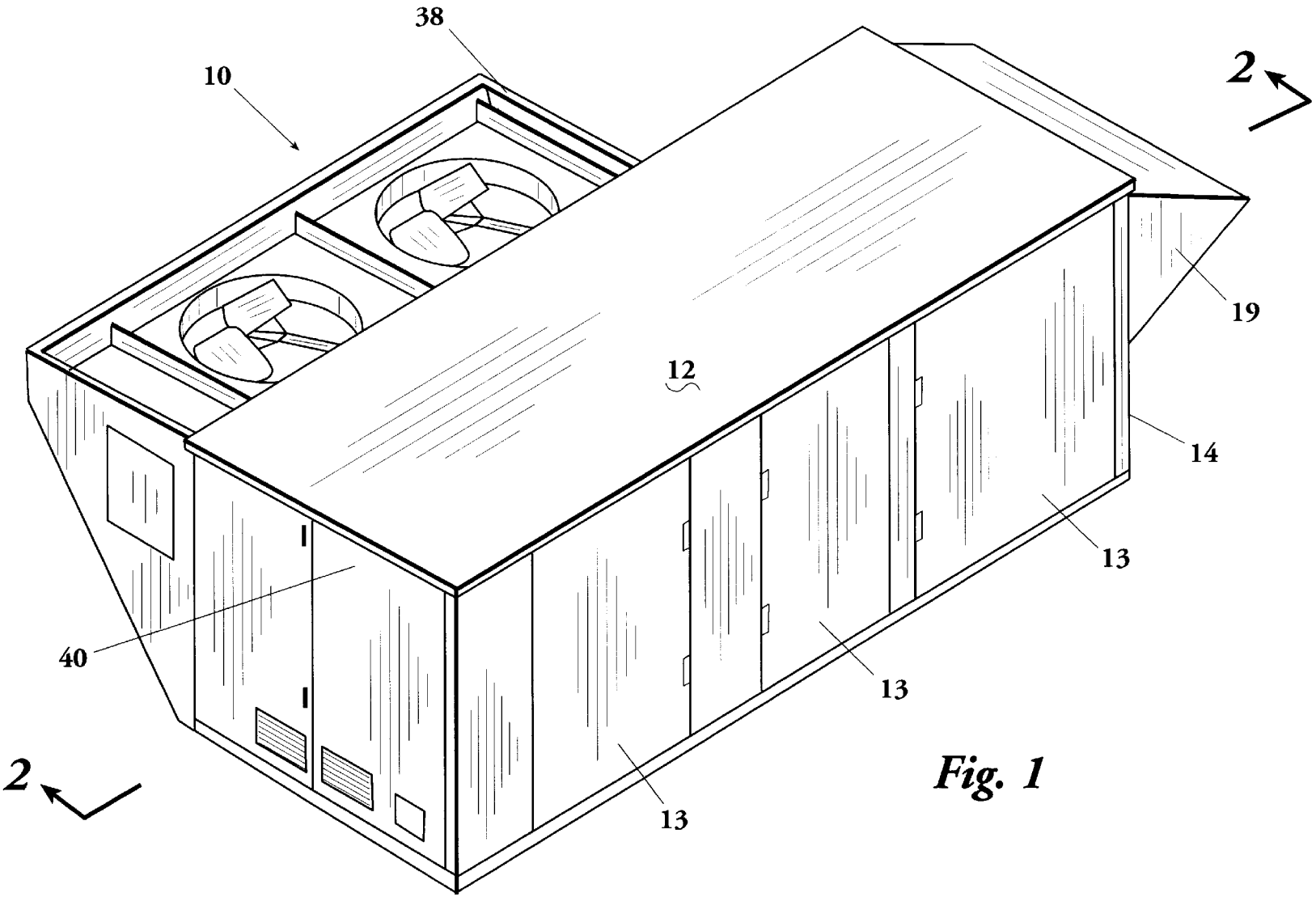
FIG. 1 is a perspective view of an air conditioning device constructed according to a preferred embodiment of the present invention and shown contained within an outside cabinet.
Figure 4:
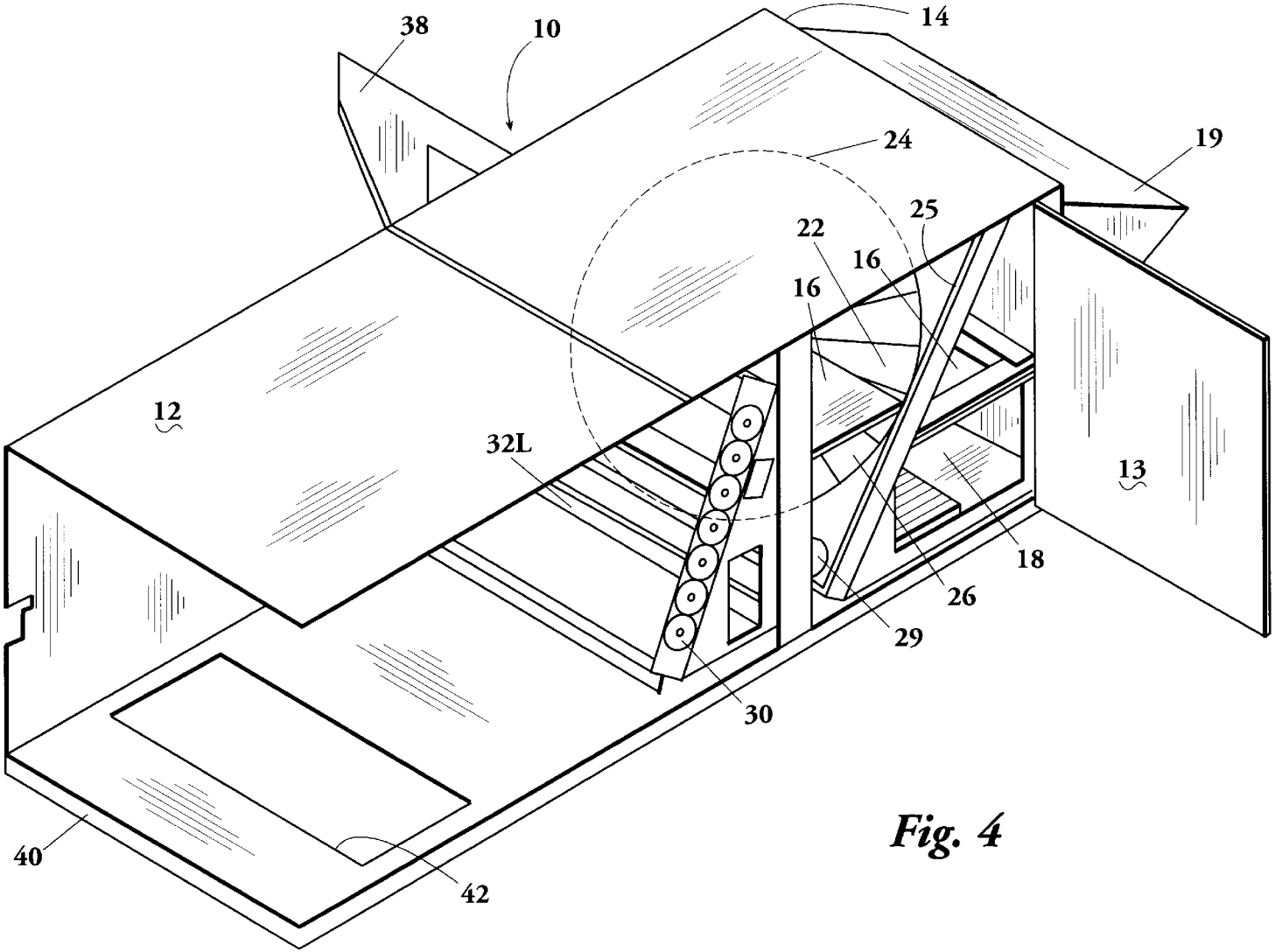
FIG. 4 is a perspective view of the air conditioning device of FIG. 1 showing access doors opened and the outside cabinet partially cut away and some of the components removed.

Referring now to FIG. 1, there is shown an air conditioning unit 10 constructed in accordance with a preferred embodiment of the present invention. The air conditioning unit 10 is housed in an external cabinet 12 which is shown in both FIGS. 1 and 2. The cabinet 12 is provided with access doors 13 which may be opened, as illustrated in FIG. 4, in order to gain access to the inside of the unit 10 in order to service it. The air conditioning unit 10 illustrated in FIG. 1 is designed to mount on a roof of a building, but the invention is not so limited in its application.

Figure 2:
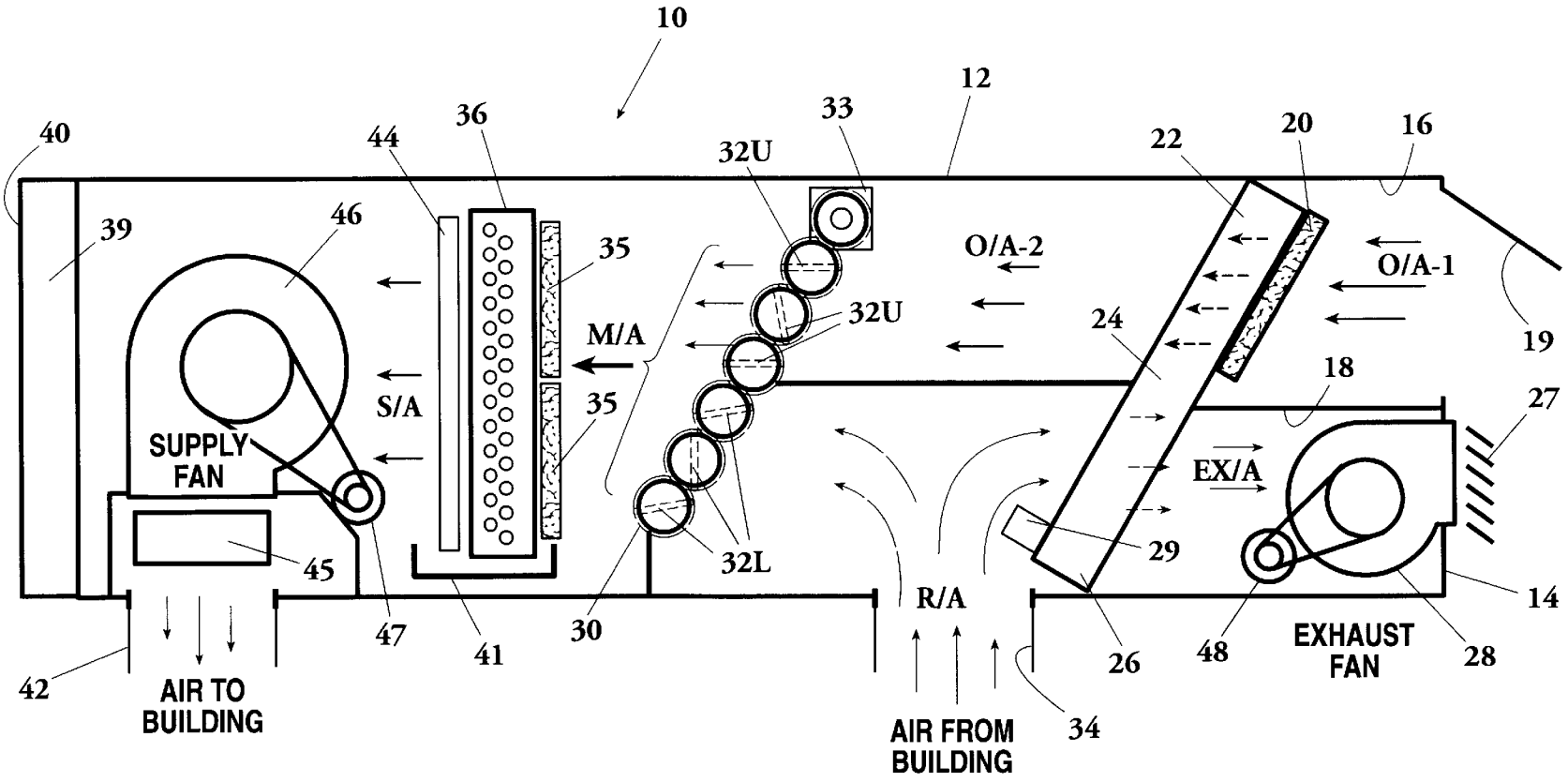
FIG. 2 is a cross sectional view taken along line 2—2 of FIG. 1 showing the arrangement of components inside the device and the airflow through those components.

Referring now to FIG. 2, the first end 14 of the air conditioning unit 10 is provided with an outside air intake duct 16 through which outside air (O/A-1) enters the unit. The flows of air streams are shown by use of arrows in FIGS. 2 and 3. The outside air intake 16 is preferably located on an upper half of the first end 14. A lower half of the first end 14 is provided with an air exhaust duct 18 so that outside air (O/A-1) entering the unit 10 via the air intake duct 16 is separated from exhaust air (EX/A) leaving the unit 10 via the exhaust duct 18. The cabinet 12 is preferably provided with a hood 19 on its first end 14 in order to protect the first end 14 from rain, ice, leaves, etc. Outside air (O/A-1) entering the unit 10 via the air intake duct 16 first passes through a particulate filter 20 provided in the air intake duct 16. The particulate filter 20 functions to remove any dirt and debris from the incoming outside air (O/A-1).

Figure 3:
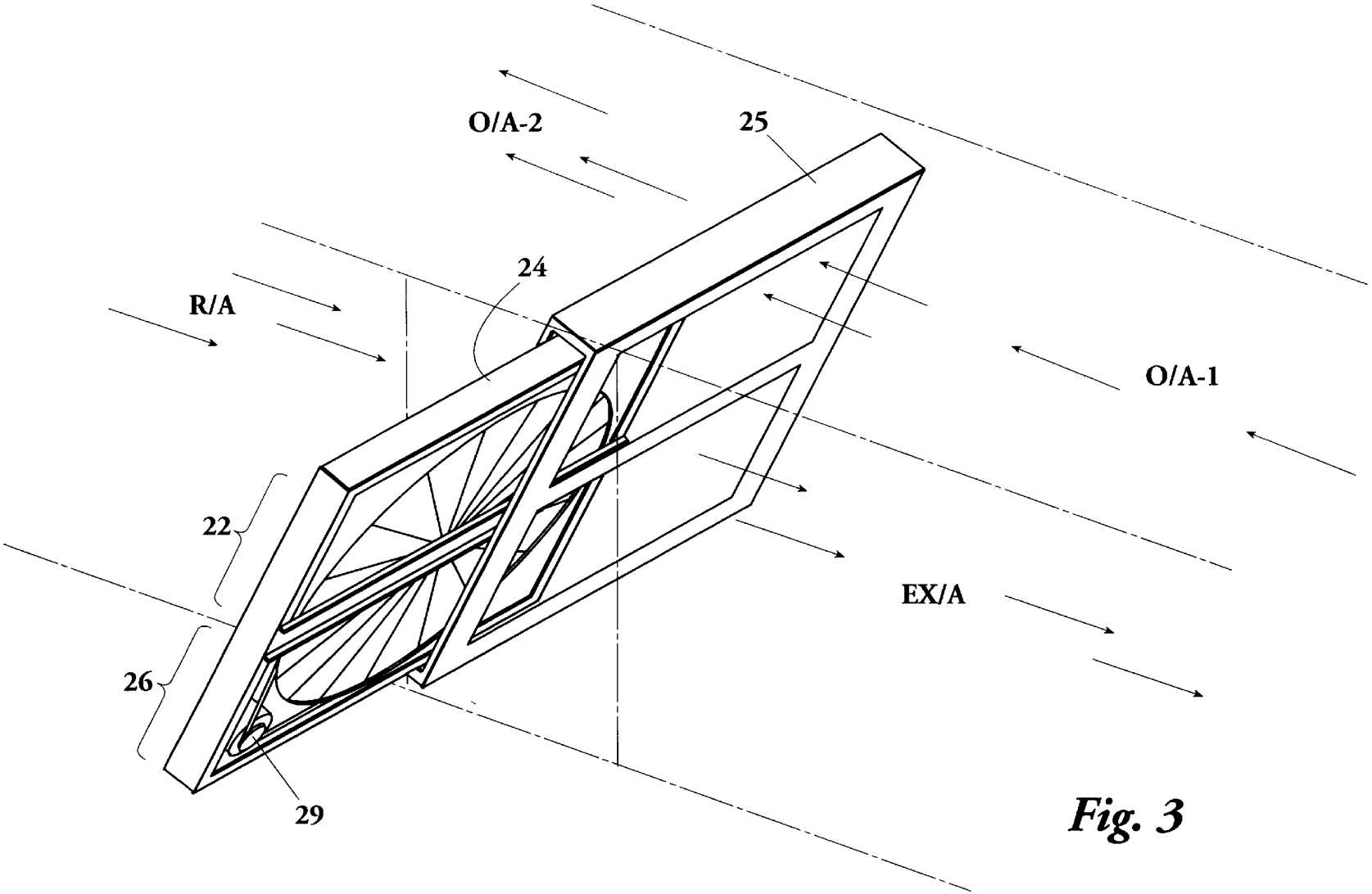
FIG. 3 is a perspective view of the heat wheel shown partially removed from the device in order to show the heat wheel in more detail.

After passing through the particulate filter 20, the outside air (O/A-1) next passes through an upper half 22 of a heat wheel 24. The heat wheel 24 is rotatably mounted within the first end 14 of the unit 10 so that the upper half 22 of the heat wheel 24 extends upward into the air intake duct 16 and a lower half 26 of the heat wheel 24 extends downward into the air exhaust duct 18. The heat wheel 24 is mounted within the unit 10 by means of a frame 25 so that the heat wheel 24 can slide within the frame 25, as illustrated in FIG. 3, in order to gain access to the heat wheel 24 for purposes of servicing it. The heat wheel 24 is located such that outside air (O/A-1) passing through the air intake duct 16 must pass through the upper half 22 of the heat wheel 24 after passing through the particulate filter 20 and exhaust air (EX/A) must pass through the lower half 26 of the heat wheel 24 before entering an exhaust fan 28 and exiting the unit 10 via a backdraft damper 27 provided at the first end 14 of the unit 10. The backdraft damper 27 is designed to prevent outside air (O/A-1) from entering the unit 10 via air exhaust duct 18.

Referring now to FIGS. 2 and 3, the heat wheel 24 is a circular wheel with a dry desiccant coated polymeric energy transfer surface, available commercially, for example, from the AIRXCHANGE Company in Rockland, Mass. The desiccant employed on the heat wheel 24 is preferably silica gel. The heat wheel 24 is driven by means of an electric heat wheel motor 29 so that it rotates slowly through the counter flowing outside air (O/A-1) and exhaust air (EX/A), absorbing sensible and latent heat from the warmer airstream, either (O/A-1) or (EX/A) and transferring this sensible and latent heat to the cooler airstream, either (EX/A) or (O/A-1) during the second half of its rotating cycle.

Thus, during summer operation when the outside air (O/A-1) is warm and humid, the upper one-half of the heat wheel 24 removes the sensible and latent heat from the outside air (O/A-1) and transfers it to the exhaust air (EX/A). Conversely, in winter, the lower one-half of the heat wheel 24 absorbs the sensible and latent heat from the exhaust air (EX/A) and transfers it to the incoming cold, dry outside air (O/A-1).

After the outside air (O/A-1) has passed through the upper one-half 22 of the heat wheel 24, it is referred to as "treated outside air" (O/A-2). The treated outside air (O/A-2) next passes through an upper half of a mixing damper 30.

As illustrated in FIG. 2, the upper half of the mixing damper 30 is the inward-most extension of the air intake duct 16 and a lower half of the mixing damper is the inward-most extension of the air exhaust duct 18. The mixing damper 30 preferably is provided with movable opposing blades 32U and 32L such that when the blades 32U in the upper half of the mixing damper 30 are closed, the blades 32L in the lower half of the mixing damper 30 are open and vice-versa. Also, when any of the blades, either 32U or 32L, are partially opened, the corresponding blades 32L or 32U are also partially open. Blades 32U and 32L are opened and closed by means of a gear driven electric motor 33 which engages an upper end of the mixing damper 30.

Building return air (R/A) enters the unit 10 via a return air duct 34 located between the lower half of the mixing damper 30 and the lower half 26 of the heat wheel 24. The building return air (R/A) may do one of three things depending upon whether the blades 32L on the lower half of the mixing damper 30 are closed, open or partially open.

First, if the blades 32L of the lower half of the mixing damper 30 are closed, the entire volume of return air (R/A) passes through the exhaust duct 18 becomes exhaust air (EX/A), passing consecutively through the lower half 26 of the heat wheel 24 and the exhaust fan 28, before exiting the unit 10 via the backdraft damper 27. In this case, the unit 10 becomes a once through system, with 100% of the air passing through the unit 10 coming from outside air (O/A-1).

Second, if the blades 32L of the lower half of the mixing damper 30 are fully open, all of the return air (R/A) passes through the mixing damper 30. In this case, the unit 10 introduces no outside air (O/A-1) into the building and the return air (R/A) is 100% recycled within the building.

Finally, which is the normal situation and as illustrated in FIG. 2, if the blades 32L on the lower half of the mixing damper 30 are partially open, a portion of the return air (R/A) passes through the mixing damper 30 and a remaining portion becomes exhaust air (EX/A) which passes through the lower half 26 of the heat wheel 24 before exiting the unit 10.

When the blades 32U and 32L of the mixing damper 30 are partially open, a portion of the return air (R/A) passes through the lower half of the mixing damper 30 and treated outside air (O/A-2) passes through the upper half of the mixing damper 30. Once the return air (R/A) and the treated outside air (O/A-2) have passed through the mixing damper 30, they mix together to form mixed air (M/A). The mixed air (M/A) then passes through a second set of particulate filters 35 and then through an evaporator 36. The purpose of the second set of particulate filters 35 is to filter out any dust or debris which may have entered the unit 10 with the return air (R/A). The evaporator 36 is connected to a condenser section 38 which is located external and adjacent to the cabinet 12, as illustrated in FIG. 1. The evaporator 36 is also connected to a compressor (not illustrated) located in compartment 39 on a second end 40 of the unit 10.

In the summertime, the evaporator 36 is operative to chill the mixed air (M/A). As the temperature of the mixed air (M/A) is lowered upon passing through the evaporator 36, the mixed air (M/A) becomes less able to retain moisture and its excess humidity condenses out onto an outside surface of the evaporator 36, runs down the outside surface of the evaporator 36 and is caught in a drip pan 41 provided thereunder. Once the mixed air (M/A) passes through the evaporator 36, it becomes known as supply air (S/A).

To control building humidity without altering the temperature of the air within the building, i.e., the space air, the unit 10 is optionally provided with a reheat coil 44 located adjacent to and on a side of the evaporator 36 opposite the air flow. Controlling humidity without changing the temperature of the space air is particularly needed in the springtime and in the fall of the year. The reheat coil 44 receives waste heat from the unit's cooling system, specifically from the compressor (not illustrated), and provides that waste heat to the chilled supply air (S/A) as the supply air (S/A) passes through the reheat coil 44. The reheat coil 44 serves to regulate the temperature of the supply air (S/A). The supply air (S/A) is blown throughout the building via the building supply air ducts 42 by means of a supply fan 46. The supply fan 46 and the exhaust fan 28 are each driven by their own electric motors 47 and 48, respectively.

Alternately, in the wintertime, the mixed air (M/A) passes through the then non-operating evaporator 36 and the non-operating optional reheat coil 44 to arrive as supply air (S/A) to the supply fan 46. An auxiliary heater 45 is provided below and adjacent to the supply fan 46 and serves to add heat to the supply air (S/A) before it passes into the building supply air ducts 42. Once it has been heated in the auxiliary heater 45, the supply air (S/A) is then blown out of the unit 10 into the building via the building supply air ducts 42. The supply air (S/A) later returns to the unit 10 as return air (R/A) via the building's return air duct 34.

While the invention has been described with a certain degree of particularity, it is manifest that many changes may be made in the details of construction and the arrangement of components without departing from the spirit and scope of this disclosure. It is understood that the invention is not limited to the embodiment set forth herein for purposes of exemplification, but is to be limited only by the scope of the attached claim or claims, including the full range of equivalency to which each element thereof is entitled.

What is claimed is:

1. An air conditioning device consisting of:

a heat wheel being rotatably provided within a device, a first portion of the heat wheel being provided in an air intake duct of the device and a second portion of the heat wheel being provided in a separate air exhaust duct of the device so that outside air entering the device passes through the first portion and exhaust air exiting the device passes through the second portion, said heat wheel transferring both sensible and latent heat between the outside air and the exhaust air such that sensible heat is transferred from a warmer stream of air to a cooler stream of air and latent heat is transferred from a wetter stream of air to a dryer stream of air;

a single mixing damper being provided within said device adjacent an evaporator and between said heat wheel and said evaporator, said mixing damper forming the innermost extensions of said air intake duct and said air exhaust duct, a return air duct being provided in the air exhaust duct between the mixing damper and the heat wheel;

a supply fan provided within said device adjacent said evaporator for blowing supply air throughout the interior of a building via a building supply air duct;

an auxiliary heater provided within said device adjacent said supply fan for heating the supply air.

2. An air conditioning device consisting of:

a heat wheel being rotatably provided within a device, a first portion of the heat wheel being provided in an air intake duct of the device and a second portion of the heat wheel being provided in a separate air exhaust duct of the device so that outside air entering the device passes through the first portion and exhaust air exiting the device passes through the second portion, said heat wheel transferring both sensible and latent heat between the outside air and the exhaust air such that sensible heat is transferred from a warmer stream of air to a cooler stream of air and latent heat is transferred from a wetter stream of air to a dryer stream of air, a single mixing damper being provided within said device adjacent an evaporator and between said heat wheel and said evaporator, said mixing damper forming the innermost extensions of said air intake duct and said air exhaust duct, a return air duct being provided in the air exhaust duct between the mixing damper and the heat wheel;

a supply fan provided within said device adjacent said evaporator for blowing supply air throughout the interior of a building via a building supply air duct;

an auxiliary heater provided within said device adjacent said supply fan for heating the supply air;

a reheat coil being provided between said evaporator and said supply fan for supplying heat to air which has passed through the evaporator.

3. An air conditioning device consisting of:

a heat wheel being rotatably provided within a device such that incoming air passes through a first portion of the rotating heat wheel and outgoing exhaust air passes through a second portion of the heat wheel, said heat wheel transferring both sensible and latent heat between the incoming air and the outgoing exhaust air such that sensible heat is transferred from a warmer'stream of air to a cooler stream of air and latent heat is transferred from a wetter stream of air to a dryer stream of air;

mixing means consisting of a single mixing damper to mix a first portion of incoming return air with the outside air after the outside air has passed through the heat wheel in order to form a mixed air stream; said mixing means being provided within the device adjacent to an evaporator;

temperature altering means for altering temperature of the mixed air stream before it is blown throughout the interior of a building as supply air by means of a supply fan; said temperature altering means being provided within the device and adjacent the supply fan;

a return air duct being provided in the device between the mixing means and a second portion of the heat wheel for receiving a return air stream from the interior of the building and splitting the return air stream into the first portion of incoming return air and the outgoing exhaust air.

4. An improved method of heating and cooling interior air using an air conditioning device employing a heat wheel consisting of the following steps:

a. moving outside air into an air conditioning device via an air intake duct provided in the device so that the outside air passes through a first portion of a heat wheel which is rotatably provided in the air intake duct;

b. moving exhaust air out of the device via an air exhaust duct provided in the device so that the exhaust air passes through a second portion of the heat wheel which is rotatably provided in the air exhaust duct;

c. transferring sensible and latent heat between the outside air and the exhaust air via the heat wheel such that simultaneously sensible heat is transferred from a warmer stream of air to a cooler stream of air and latent heat is transferred from a wetter stream of air to a dryer stream of air;

d. splitting a return air stream which enters the device via a return air duct from a building into two air streams which are a first return air stream and the exhaust air;

e. passing the outside air and the first return air stream through a mixing damper to mix them together in order to form a mixed air stream;

f. passing the mixed air stream over an evaporator provided within the device adjacent to the mixing damper, passing the mixed air stream through a reheat coil and then passing the mixed air stream into a supply fan provided adjacent to the reheat coil in the device;

g. blowing the mixed air stream out of the supply fan so that the mixed air stream passes through an auxiliary heater provided in the device adjacent to the supply fan before being blown throughout the building via a building supply air duct.

* * * * *